US006027061A

United States Patent [19]

Busch et al.

[11] Patent Number: 6,027,061

[45] **Date of Patent: *Feb. 22, 2000**

[54] YARN WINDING APPARATUS AND METHOD

[75] Inventors: Hans Jochen Busch, Remscheid; Jorg Spahlinger, Wermelskirchen, both of Germany

[73] Assignee: Barmag AG, Remscheid, Germany

[ * ] Notice: This patent is subject to a terminal disclaimer.

[21] Appl. No.: 08/917,071

[22] Filed: Aug. 22, 1997

[30] Foreign Application Priority Data

Aug. 22, 1996 [DE] Germany ..... 196 33 790

[51] Int. Cl.[7] ..... B65H 54/02

[52] U.S. Cl. ..... 242/474.6; 242/474.5; 242/486.4

[58] Field of Search ..... 242/474.4, 474.5, 242/474.6, 486.4, 486.2

[56] References Cited

U.S. PATENT DOCUMENTS

| | | |
|---|---|---|
| 3,409,238 | 11/1968 | Campbell et al. . |
| 3,532,278 | 10/1970 | Sparling . |
| 4,114,820 | 9/1978 | Lafeber . |
| 4,298,171 | 11/1981 | Flückiger et al. . |
| 5,029,762 | 7/1991 | Behrens et al. . |
| 5,816,513 | 10/1998 | Spahlinger . |

FOREIGN PATENT DOCUMENTS

| | | |
|---|---|---|
| 0 799 787 | 10/1997 | European Pat. Off. . |
| 25 23 771 | 8/1977 | Germany . |
| 43 21 111 | 1/1994 | Germany . |

OTHER PUBLICATIONS

Patent Abstracts of Japan, vol. 096, No. 001, Jan. 31, 1996 & JP 07232864, Sep. 5, 1995.

Patent Abstracts of Japan, vol. 097. No. 003, Mar. 31, 1997 & JP 08290870, Nov. 5, 1996.

Patent Abstracts of Japan, vol. 096, No. 011, Nov. 29, 1996 & JP 08192959, Jul. 30, 1996.

*Primary Examiner*—Michael R. Mansen

*Attorney, Agent, or Firm*—Alston & Bird LLP

[57] ABSTRACT

A yarn winding machine for winding an advancing yarn to form a yarn package which is formed on a driven winding spindle that is mounted in a projecting manner on a rotatable revolver. The package is engaged on its circumference by a pressure roll which exerts an abutment force on its surface. The winding spindle is supported on a mobile carrier which is mounted on the revolver. During the build of the package, the axial spacing between the package and the pressure roll is changed as a result of an evasive movement, it being possible for the evasive movement to be accomplished in several stages by the movement of the carrier while the revolver is fixed, or by the rotation of the revolver while the carrier is fixed, and so that the abutment force exerted by the pressure roll can be changed.

7 Claims, 7 Drawing Sheets

YARN WINDING APPARATUS AND METHOD

BACKGROUND OF THE INVENTION

The present invention relates to a yarn winding apparatus of the type having a rotatable revolver which mounts a pair of winding spindles, and wherein the spindles are serially delivered to a winding position and a doffing position as the revolver is sequentially rotated.

In the known winding machines of the described type, the growth or build in the diameter of the package is in the course of winding a package accommodated by means of an evasive movement of the package or of the pressure roll. In this connection, the abutment force between the package and the pressure roll is predetermined by hydraulic or pneumatic force-transmitters and is held substantially at a constant value during winding.

In the case of the winding device known from U.S. Pat. No. 4,298,171, the winding spindle is moved away from the fixed pressure roll by means of the rotary motion of a revolver during winding. In this connection, the winding spindle is supported on a rocker which is capable of being pivoted relative to the revolver by means of a force-transmitter. In the winding region, the winding spindle is pressed with the package to be formed against the fixed pressure roll. In this connection, the rotary motion of the revolver for the purpose of forming the package is controlled in such a way that the relative location of the rocker on the revolver remains unchanged. The abutment force between the pressure roll and the package is predetermined by the force-transmitter. In this connection, the winding region is dependent on the magnitude of the diameter of the revolver.

In the case of the winding machine known from DE 25 23 771 and corresponding U.S. Pat. No. 4,114,820, a winding spindle that receives the package is moved away in a straight line from a pressure roll by means of a linear guide mechanism during winding. In this connection, the effective direction of the abutment force of the pressure roll relative to the surface of the package remains constant. The pressure force is determined by means of a pneumatic cylinder.

In the case of the known winding machines, the abutment force between the package and the pressure roll is applied by the same control device that also controls the evasive movement between the pressure roll and the winding spindle. In this connection undesirable changes in the abutment force arise by reason of stick-slip effects.

In the course of winding a package, it is in fact desirable that the pressure force does not remain constant during the build of the package. For instance, a low pressure force is often required at the beginning of winding in order not to press the initial layers into one another. In the further course of winding a higher pressure force is required, in order, for example, to increase the packing density. However, with a view to avoiding bulging of the package it is also necessary to maintain regions having low pressure forces during winding.

It is therefore an object of the invention to develop an improved winding machine of the described type, wherein the yarn is wound in stages with, in each instance, different but constant abutment forces between the package and the pressure roll.

It is also an objective of the invention to provide a winding apparatus of the described type which has a compact style of construction and which is able to wind large packages.

SUMMARY OF THE INVENTION

The above and other objects and advantages of the present invention are achieved by the provision of a yarn winding apparatus which comprises a revolver mounted for rotation about a central axis, and a revolver drive for rotating the revolver about the central axis. At least one winding spindle is mounted to the revolver by a carrier for rotation about an axis which is parallel to and laterally offset from the central axis, and the carrier also permits movement of the winding spindle with respect to the revolver in a essentially radial direction with respect to the central axis. A pressure roll is mounted so as to engage with an abutment force the circumferential surface of the package being wound about the winding spindle, and a control is provided for independently controlling the revolver drive and the movement of the carrier, such that the direction of movement of the winding spindle away from the pressure roll can be changed during the build of a package, to thereby change the abutment force between the pressure roll and the package.

A winding machine is known from DE 43 21 111 in which the winding spindle is capable of being moved by means of a rocker that is supported on the revolver so as to be capable of pivoting. In this case, the rocker is attached to the revolver in such a way that the winding spindle is only capable of being moved away from the pressure roll contrary to the direction of rotation of the revolver. During the entire build of the package, this arrangement consequently only permits an evasive movement by means of the revolver.

In the case of the winding machine according to the invention for winding a running yarn, the evasive movement in the course of winding is accomplished in several stages by the movement of the carrier on the fixed revolver and by rotation of the revolver with the carrier fixed. By this means the evasive movement between the pressure roll and the package is graduated in stages with, in each instance, a different direction of motion. Each of the directions of motion is characterized by a typical guide path on which the winding spindle is moved. The particular advantage in this connection lies in the fact that, in quite specific manner, the changes in the weight-force component of the pressure roll by reason of the relative change of location between package and pressure roll are employed for the purpose of influencing the abutment force. In addition it is possible, while adhering to small dimensions of the revolver, for packages of large size to be wound.

In the case of a mobile pressure roll, the abutment force between the package and the pressure roll is determined substantially by the weight force of the pressure roll. The present invention is based on the perception that the abutment force that results from the weight of the pressure roll, or that is determined by the effective direction of force in the case of a fixed pressure roll, is capable of being changed by the position of the pressure roll in relation to the package. Consequently the abutment force can be influenced in very simple manner by the evasive movement of the package or of the pressure roll during winding. Particularly in connection with the formation of the package it is advantageous if the abutment force is variable.

A further advantage of the invention lies in the possibility of combination and in the variation of number and sequence of stages with a view to changing the axial spacing. Hence, highly individual package formations can be produced, both in the case of random winding and in the case of a precision winding.

The winding machine of the present invention permits winding with a substantially constant abutment force in the first phase of winding. Hence the initial layers of yarn are not damaged in the event of excessive abutment force and are not wound too loosely in the case of an abutment force that is too low. In this phase of winding, the winding spindle is moved relative to the pressure roll preferably with the aid of a carrier on the fixed revolver. In this connection the winding spindle may be moved on a straight or slightly curved guide path, so that the position between the pressure roll and the package is essentially changed only slightly. In the further course of winding, with a view to increasing the packing density for example, an increase in the abutment force is advantageous, this being brought about by an evasive movement of the package by means of the rotation of the revolver. As a result of the movement on the revolver, a steady change of position between the pressure roll and the package is produced. Hence the weight component of the abutment force is influenced.

The winding machine of the present invention also permits the package to be wound at the beginning with increasing abutment force and, in the further course of the build of the package, with an abutment force that is as constant as possible.

By combining the movement of the carrier and the rotary motion of the revolver, it is possible to capture the rapidly growing diameter of the package at extremely high winding speeds without the abutment force being given an impermissible deviation from the predetermined target value.

The carrier is preferably constructed to permit movement of the winding spindle between a first radially outer position, which may be outside the perimeter of the revolver, and a second radially inner position, which may be radially within the perimeter of the revolver. This construction is particularly advantageous in order to wind very thick package. As a result of the partitioning of the evasive movement into stages, even with individual, relatively compact and small components an evasive displacement that is as large as possible for the purpose of forming the package can be realized.

The carrier and/or the revolver are also able to be driven in a stepwise manner. This is particularly advantageous in order to wind on yarns having a low titre or in order to wind on yarns at low yarn speeds.

In connection with the winding-on of yarns having relatively high titres, such as in the case of carpet yarn for example, the winding machine is preferably constructed so that the carrier and/or the revolver may be driven continuously. In this case it is particularly advantageous if the drive of the carrier and/or of the revolver is effected by means of frequency-controlled electric motors.

The winding spindle is movable back and forth on a guide path by the carrier. This is particularly advantageous in connection with capturing the yarn on an empty tube at the beginning of the build of the package. By this means, possibilities arise of pivoting the winding spindle with the empty tube from the outer position or from the inner position into the yarn line. Hence the yarn can be captured in synchronous operation—i.e., empty tube and yarn have the same direction of motion—or in reverse operation—i.e., yarn and empty tube have contrary directions of motion.

The carrier may be constructed as a bearing block which is supported in a linear guide channel on the revolver, and which is moveable by a linear actuator. This construction has the advantage that at the stage at which the carrier performs the evasive movement of the winding spindle the abutment force between the package and the pressure roll remains substantially constant.

The carrier may also be constructed as a rocker arm which is pivotally mounted to the revolver, and which is pivoted by an actuator. In this case the magnitude of the evasive movement of the winding spindle that is capable of being accomplished by the drive of the rocker arm is independent of the dimensions of the revolver. This design is therefore particularly suitable in order, with a compact style of construction, to wind packages having a relatively large diameter.

The carrier may further be constructed as a spindle turret which is eccentrically mounted on the revolver. The drive of the spindle turret and also the drive of the revolver are advantageously controlled in such a way that a superposition of the rotary motion is also possible. By this means the geometrical relationships between the pressure roll and the winding spindle in the course of winding, and hence also the abutment force, can be changed in various ways. In this case the drives may be constituted by individual motors controlled by frequency converters. Both drives may be advantageously coupled by means of a programmable control system. Hence any combination of the rotary motions of the spindle turret and of the revolver can be assigned to the winding machine. Hence in the winding region it is possible to run through a predetermined profile of the contact force between the pressure roll and the package.

At the end of the build of a package, and during the transition between the winding position and the doffing position, and vice versa, the winding spindle preferably remains in its inner relative position on the revolver. This is desirable in order to achieve a machine separation that is as close as possible.

The winding machine according to the invention is particularly suitable for those variants in which the pressure roll is fixed in relation to the package. In this case the control of the drive motors of the revolver and of the carrier could be effected by means of a sensor that detects the abutment force between the surface of the package and the pressure roll.

The control system of the revolver that has become known from EP 0 374 536 and corresponding U.S. Pat. No. 5,029,762 may also, however, be extended without difficulty to the drive of the carrier. In this connection the movement of the pressure roll, which is supported on a rocker, is detected and utilized for the purpose of controlling the drives.

The mobility of the pressure roll may, however, also be utilized advantageously for the purpose of increasing the parking-time. To this end, neither the revolver nor the carrier are driven in the winding region at the beginning of the build of the package. Consequently, with a view to forming the package, the pressure roll is urged out of its position away from the growing diameter of the package. After the stroke limit-stop of the pressure roll has been reached, the carrier or the revolver is activated so that the pressure roll reassumes its original position.

BRIEF DESCRIPTION OF THE DRAWINGS

Some of the objects and advantages of the present invention having been stated, others will appear as the description proceeds, when considered in conjunction with the accompanying schematic drawings, in which.

DETAILED DESCRIPTION OF THE PREFERRED EMBODIMENTS

Figure 1:
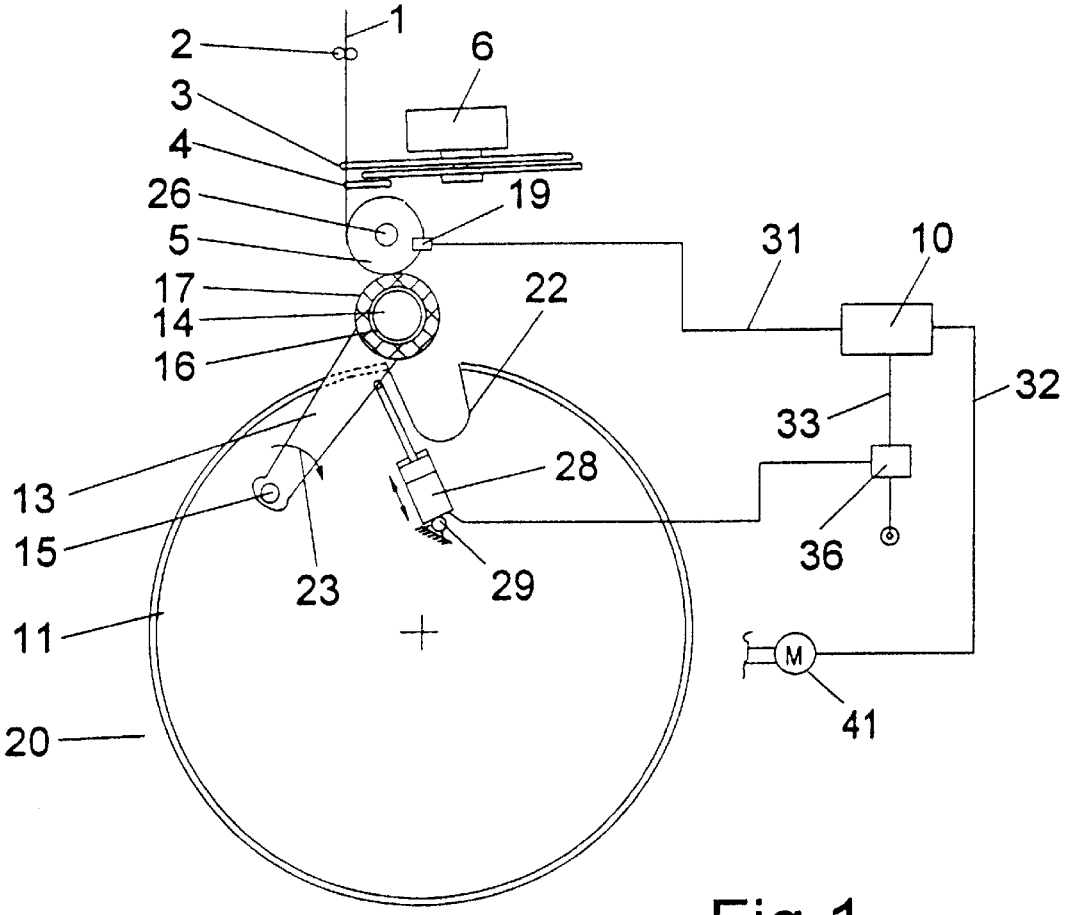
FIG. 1 is a side elevation view of a winding apparatus which embodies the features of the present invention, and shown at a first stage of the winding operation.

Referring more particularly to FIG. 1, the winding apparatus of the present invention includes provision for guiding and advancing yarn 1 through a fixed yarn guide 2 and to a known traversing device, which consists of a traversing drive 6 and flyers 3. The flyers 3 guide the yarn 1 alternatingly back and forth along a guide plate 4 within the limits of a traversing stroke. The yarn 1 then engages and partially encircles a pressure roll 5. The yarn is then deposited onto a package 17. The package 17 is formed on a bobbin tube 16 which is coaxially mounted onto a rotatable winding spindle 14. During winding, the pressure roll 5 that is radially mobile in relation to the package rests in close contact with the circumference of the package 17 subject to an abutment force. For its part, the winding spindle 14 is supported in a projecting manner on a rocker arm 13. The rocker arm 13 is secured on a rotatable revolver 11 with the aid of a rocker pivot 15. The revolver 11 is arranged rotatably in a machine frame with the aid of a bearing 20. The rocker arm 13 is capable of being pivoted relative to the package revolver by means of a linear drive actuator 28 from an outer position into an inner position or vice versa. The linear drive actuator 28 is also mounted on the revolver 11 with the aid of the attachment 29. In the position shown in FIG. 1, the rocker arm 13 is pivoted with the supported winding spindle 14 in such a way that the winding spindle is located outside the circular periphery of the revolver 11. For this purpose a recess 22 is arranged on the periphery of the revolver 11. In order to wind the yarn 1, the spindle 14 is driven. In this connection the drive could be effected either by means of a driven pressure roll 5 and by means of a direct spindle drive. The pressure roll 5 is equipped with a sensor 19 which is connected by means of the sensor line 31 to a control device 10. By means of the control device 10 the linear drive actuator 28 can be triggered via control line 33 and valve 36, or the revolver drive 41 can be triggered via control line 32.

In accordance with the invention the winding process is subdivided into several stages, whereby the evasive movement of the package is accomplished at each stage by different means. After the yarn 1 has been captured on a tube 16, the pressure roll 5 is brought into circumferential contact with the package 17, whereby a predetermined abutment force, supported for example by a force-transmitter on the pressure roll, acts on the surface of the package. In the position shown in FIG. 1, the winding begins at the first stage. In this case the position of the pressure roll does not change substantially. The evasive movement for the purpose of forming the package 17 is accomplished by means of the rocker arm 13, whereby the winding spindle 14 is guided on a partially circular guide path to an inner relative position on the revolver 11. The revolver drive 41 is not activated in this phase of winding. By means of the control device 10 the evasive movement of the rocker arm is predetermined by the linear drive actuator 28. In this connection, the rocker arm can be moved continuously or in a stepwise manner. In order that the circumferential contact between the pressure roll 5 and the package 17 is not interrupted during winding, a predetermined minimal abutment force or a change in position on the pressure roll is measured by means of the sensor 19 and signalled to the control device 10. In this connection the control device 10 is programmed in such a way that, depending on the winding situation, either the linear drive actuator 28 or the revolver drive 41 is activated.

Figure 2:
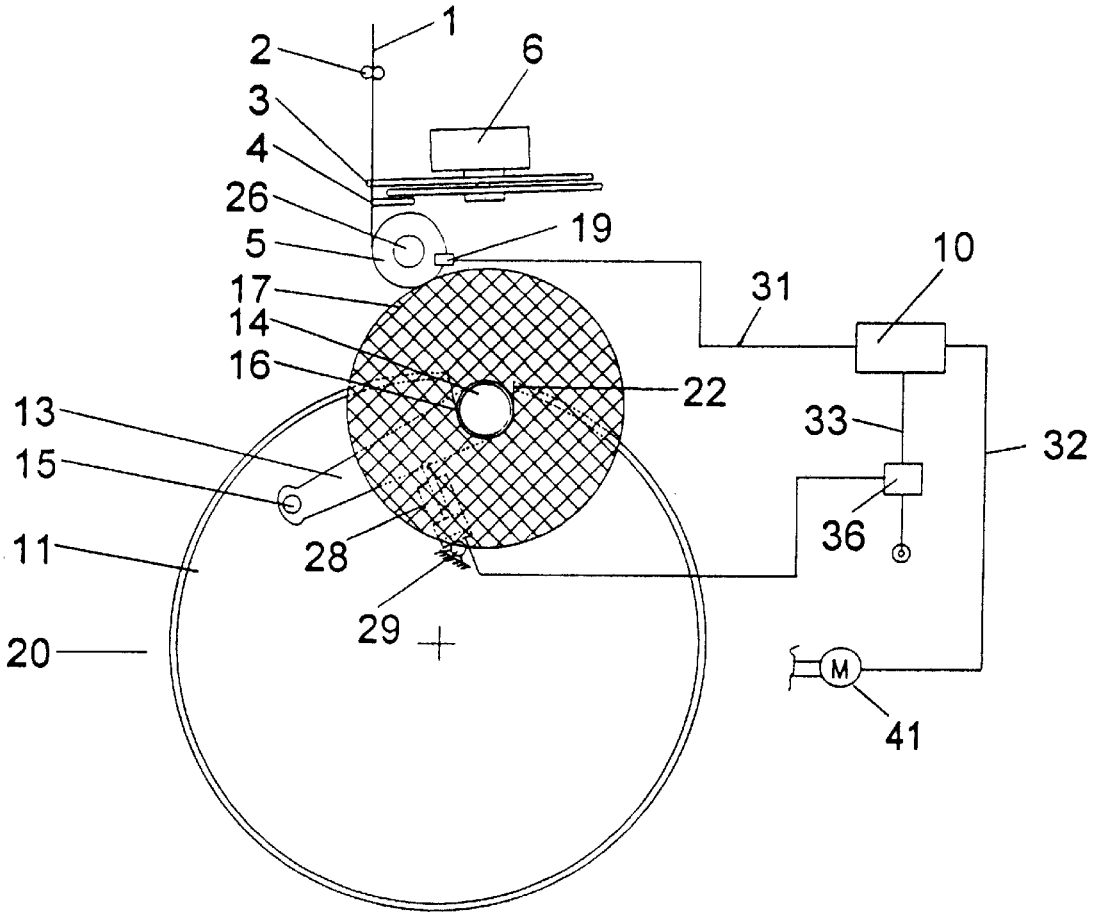
FIG. 2 is a view similar to FIG. 1 at the end of the first stage of the winding operation.
Figure 3:
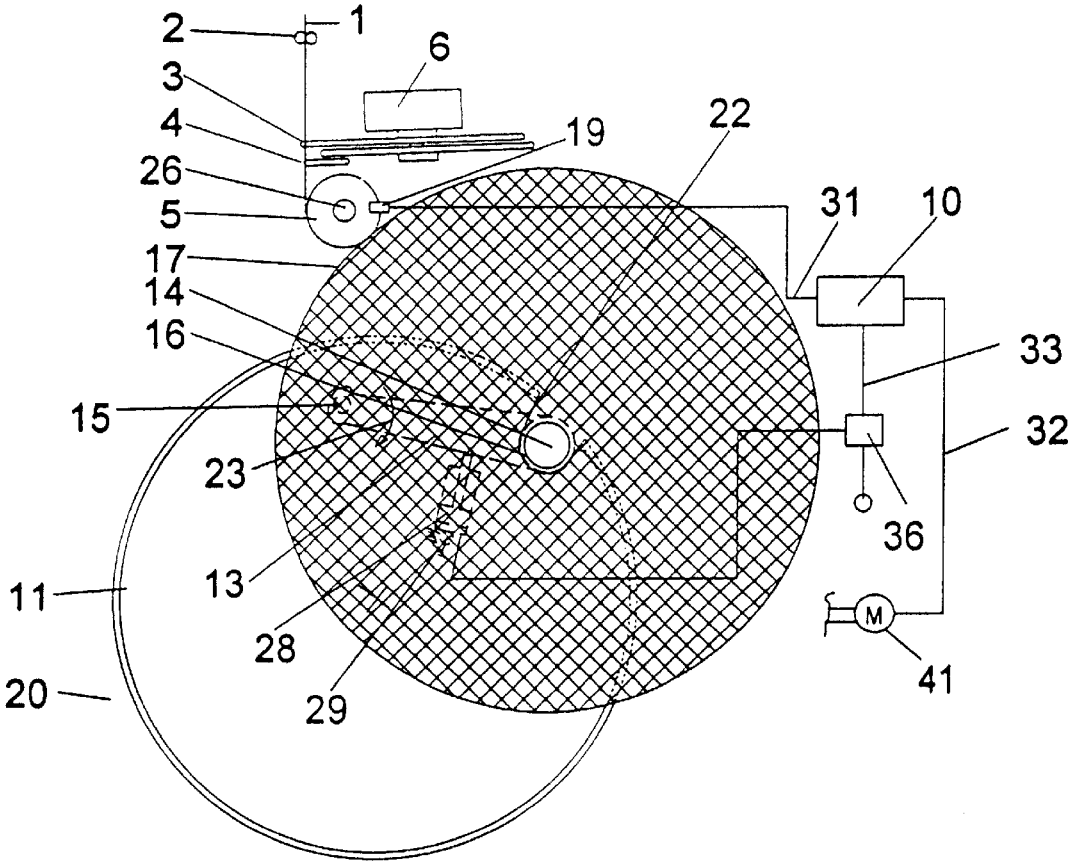
FIG. 3 is a view similar to FIG. 1 at a second stage of the winding operation.

In FIG. 2 and FIG. 3 the winding machine from FIG. 1 is shown at various stages of winding. With regard to the construction, reference is made to the description relating to FIG. 1. In FIG. 2 the package 17 has grown to such an extent that the rocker 13 has reached the inner relative position on the revolver 11. This would conclude the first stage of winding. In this connection the relative location between the pressure roll 5 and the package 17 has changed only slightly. Consequently in this phase the component of the abutment force resulting from the weight of the pressure roll has remained substantially constant. In FIG. 3 the further sequence of the winding process is shown. The evasive movement of the package 17 is accomplished at the second stage by means of the rotation of the package revolver. In this phase of the winding process a steady change in the abutment force is brought about by reason of the change of position between the pressure roll 5 and the package 17.

The control device 10 may, however, also be programmed in such a way that an alternation between the first stage and the second stage is carried out several times.

Figure 4:
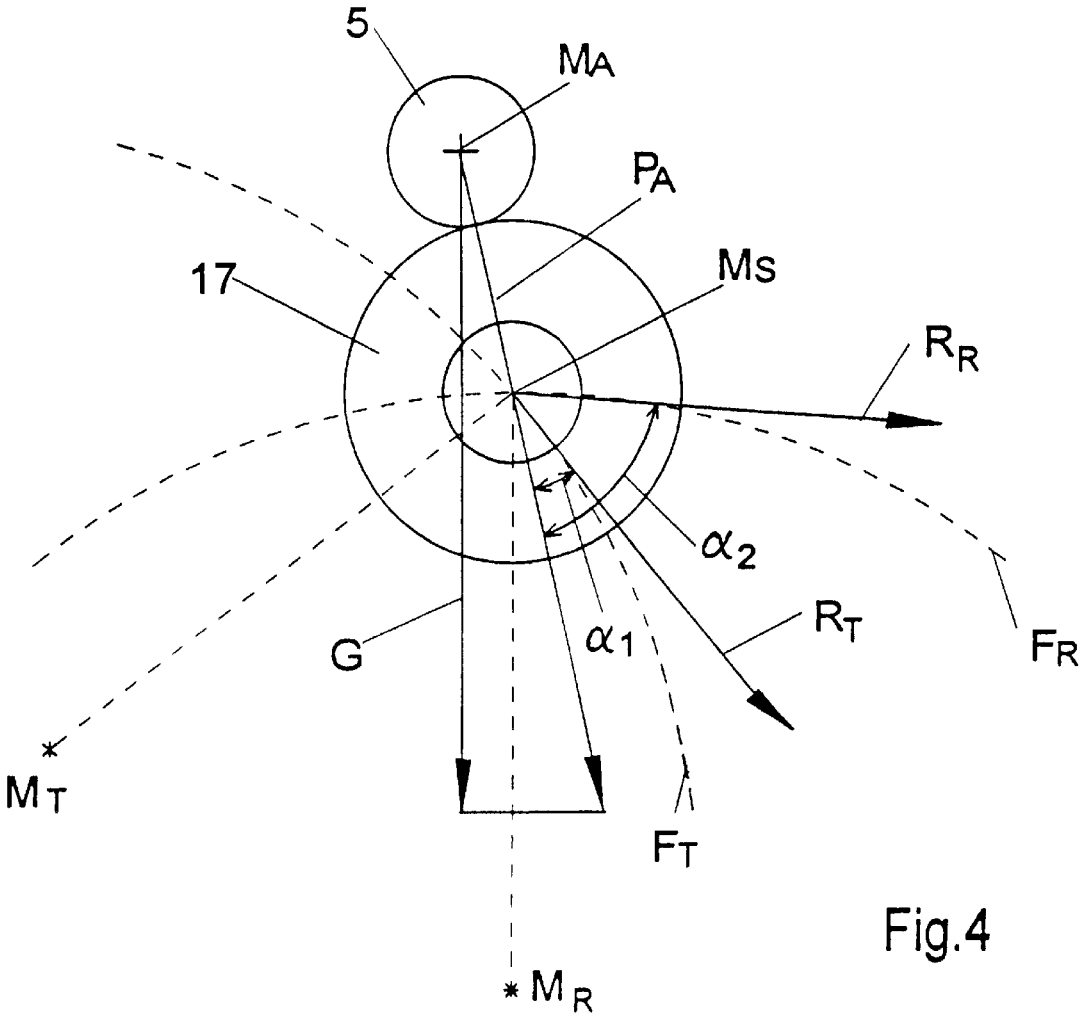
FIG. 4 is a diagram illustrating the abutment force between the pressure roll and the package.

The abutment force acting between the pressure roll and the package results from the weight force of the pressure roll. In FIG. 4 the force relationship between the pressure roll 5 and the package 17 is shown. The weight force of the pressure roll is designated by G, which has a vertical effective direction. The abutment force $P_A$ that acts between the pressure roll 5 and the package 17 has by way of effective direction the connecting line between the axial mid-point $M_A$ of the pressure roll and the axial mid-point $M_S$ of the winding spindle.

In order to enable the growth in the diameter of the package 17 the possibility now exists of moving the winding spindle with the carrier that is constructed as a rocker arm. In this connection the axial mid-point $M_S$ of the winding spindle will move on a circular guide path $F_T$, the mid-point of which is constituted by the axial mid-point $M_T$ of the pivotal axis of the carrier or of the rocker arm. In this case the package 17 will move in the direction of motion $R_T$.

However, there is also the possibility of moving the winding spindle with the package revolver in order to enable the growth in the diameter of the package. In this case the axial mid-point $M_S$ of the package spindle would move on a circular guide path $F_R$ which has as mid-point the axial mid-point $M_R$ of the revolver. In this case the package 17 would move away in the direction of motion $R_R$.

The difference between the effective direction of the abutment force $P_A$ and the direction of motion R of the package is characterized by an angle $\alpha$. In this connection the relationship that applies is that the smaller the angle $\alpha$, the smaller the change in the abutment force $P_A$ that occurs during the excursion of the package. From FIG. 4 it can be gathered that an angle $\alpha 1$ is opened out between the effective direction of the abutment force $P_A$ and the direction of motion $R_T$ brought about by the carrier. On the other hand, the angle $\alpha 2$ is opened out between the effective direction of the abutment force $P_A$ and the direction of motion $R_R$ generated by the revolver. Angle $\alpha 2$ is very much larger than angle $\alpha 1$. Hence in the event of rotation of the revolver during the build of the package a relatively significant increase in the abutment force $P_A$ will occur. This increase could, in the course of formation of the package 17 for example, have an effect of an increase in the packing density. On the other hand, the movement of the winding spindle by the carrier or the rocker arm results in the fact that the abutment force $P_A$ adjusted at the start of the build of the package changes only negligibly. Hence the winding machine according to the invention offers the possibility, solely by changing the direction of motion of the winding spindle, of adjusting an abutment force that is desirable for the formation of the package. Depending on requirements, in this connection the weight force G of the pressure roll could be increased by a constant value or relieved by means of a force-transmitter.

Figure 5:
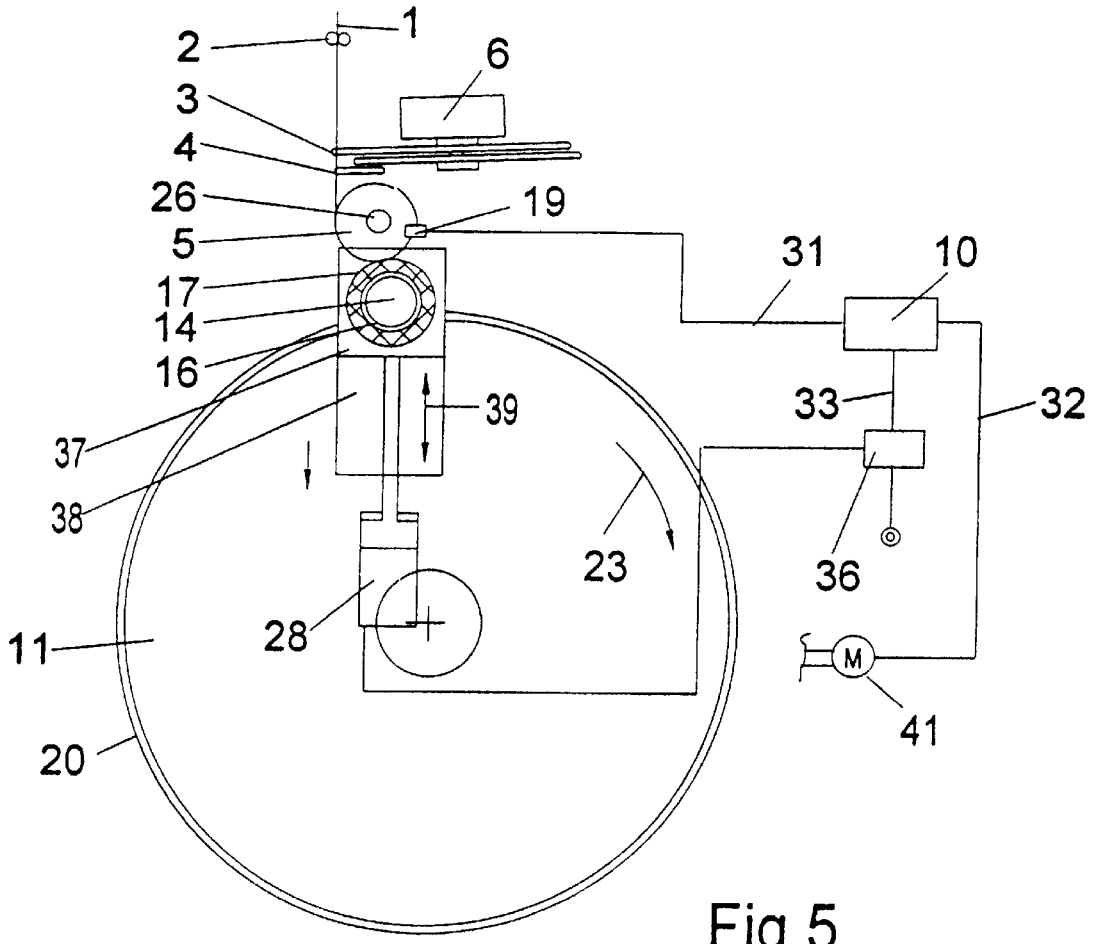
FIG. 5 is a view similar to FIG. 1 and illustrating a second embodiment of the carrier for the winding spindle.

In the case of the embodiment example shown in FIG. 5, the winding spindle is supported in a bearing block 37. The bearing block 37 is guided in a linear guide channel 38 on the revolver. By means of the linear drive actuator 28 it is consequently possible for the winding spindle to be moved from an outer position into an inner position and vice versa. This design has the particular advantage that there is no change of position between the pressure roll 5 and the package 17 as a result of the movement of the carrier. With regard to the construction and the triggering, reference is made to the description relating to FIGS. 1 to 3.

Figure 6:
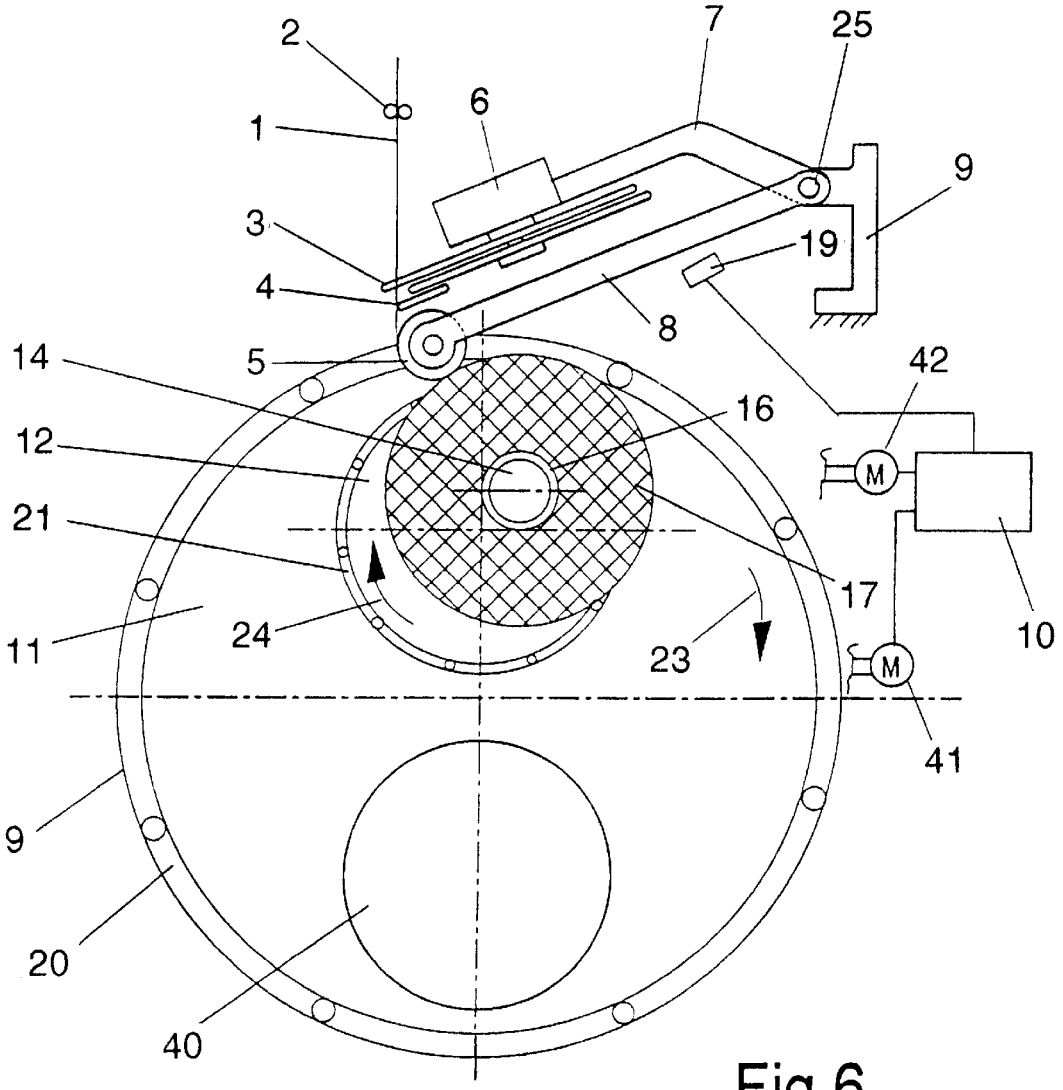
FIG. 6 is a view similar to FIG. 1 and illustrating still another embodiment of the carrier or the winding spindle.

Represented schematically in FIG. 6 is a view of a winding machine in which the winding spindle 14 is supported on a spindle turret 12. The winding machine comprises a revolver 11 which is rotatably supported in a machine frame 9 by means of the bearing 20. In this connection the revolver 11 is driven by an electric motor 41. In the package revolver 11, the spindle turret 12 is rotatably supported eccentrically with the aid of the bearing 21. The spindle turret 12 is driven with the aid of an electric motor 42. On the spindle turret 12, the winding spindle 14 is supported eccentrically in a projecting manner. The spindle 14 is located in the winding region. In the position shown, the yarn 1 runs to the traversing device via the top yarn guide 2. The traversing device takes the form of a flyer traversing mechanism with the flyers 3. The flyers 3 guide the yarn 1 alternatingly back and forth along the guide plate 4 within the limits of the traversing stroke. In this connection, the yarn partially encircles the pressure roll 5 and is and deposited directly onto the package 17. The package 17 is formed on the bobbin tube 16 and rotates with the spindle 14. The pressure roll 5 is supported on a rocker 8. The rocker 8 is connected in the rotatable joint 25 to the machine frame 9. Below the rocker 8 a sensor 19 is arranged which is connected to its control device 10. The control device 10 is connected in each instance to the drive motors of the spindle turret 12 and to the drive motor of the revolver 11.

In the case of the winding machine shown in FIG. 6, in the event of a growing package 17 the pressure roll 5 is lifted out of its target position, an operation which is detected directly by the sensor 19 as a result of a change in position and is converted into a signal. This signal is supplied to the control device 10. The control device is programmed in such a way that it first activates the drive of the spindle turret 12. The spindle 14 and package 17 are displaced in the direction of rotation 24 of the turret 12 relative to the fixed revolver 11, which may be considered to be in an essentially radial direction with respect to the central axis, so that the axial spacing between the pressure roll 5 and the spindle 14 increases. In this situation, the drive of the revolver 11 is not activated. With this embodiment, the package revolver 11 is rotated in the second stage of winding while the spindle turret 12 remains fixed.

Figure 7:
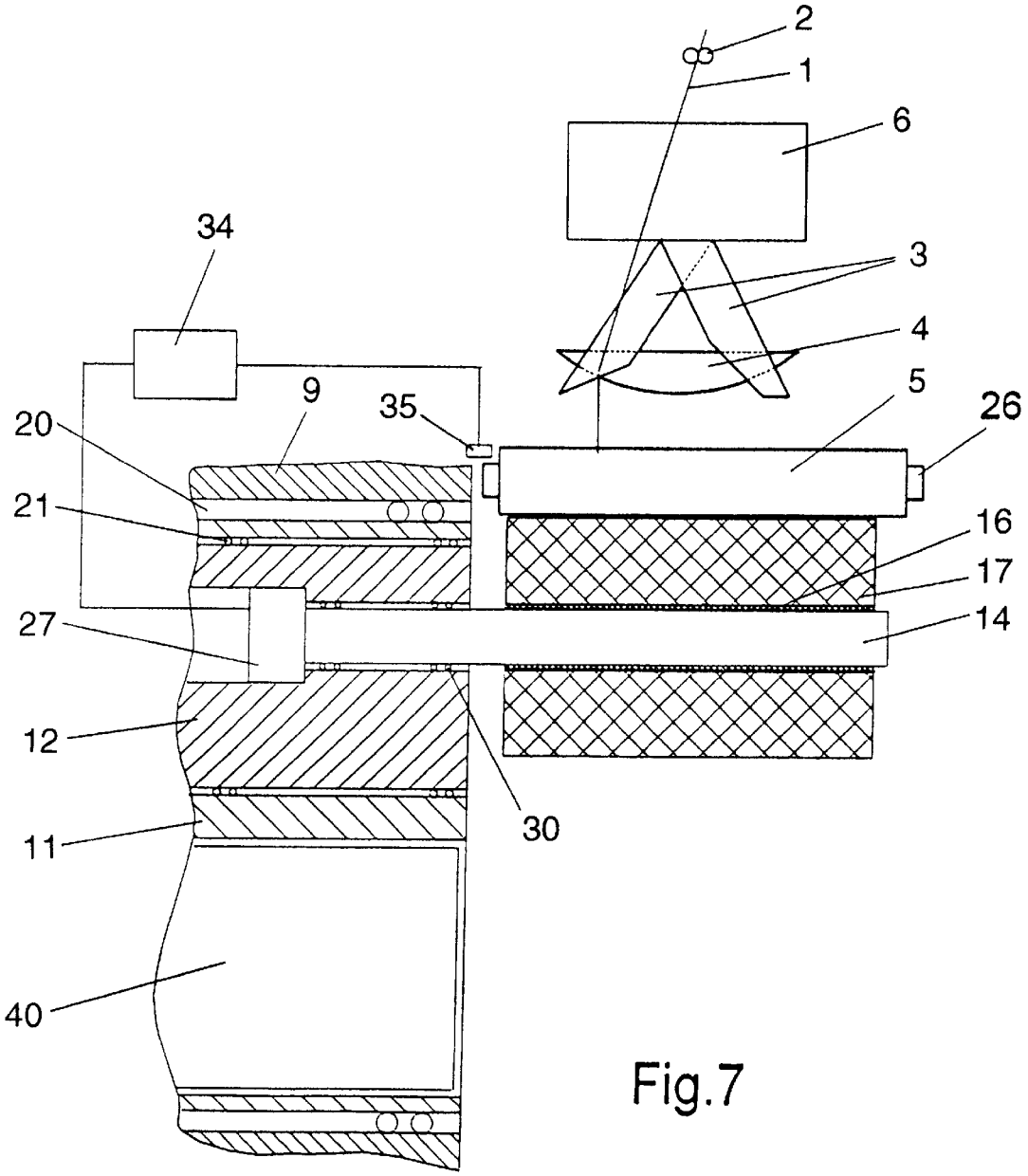
FIG. 7 is a fragmentary sectional view of the apparatus shown in FIG. 6.

In FIG. 7 a sectional representation of the winding machine from FIG. 6 is represented schematically. The spindle 14 is located in this case in the winding region. In this connection the spindle 14 is supported in the spindle turret 12 by means of the bearing 30. The spindle 14 is driven by means of the spindle drive 27. In order that the circumferential speed at the surface of the package can be kept constant during the build of the package, the rotational speed of the pressure roll 5 is detected by means of the sensor 35 and supplied to the control device 34. The control device 34 converts the signals into control pulses that are supplied to the spindle drive 27 and consequently controls the drive of the spindle 14. The motor 42 of the spindle turret 12 is preferably arranged in the revolver 11. In this connection the spindle turret is preferably driven by means of a chain drive. The motor 41 of the revolver 11 is arranged on the machine frame 9.

In order to be able to wind a continuously running yarn, winding machines are required having, in each instance, two winding spindles supported on the revolver, as is conventional. As shown in FIG. 6 and FIG. 7, an arrangement of this type can be realized by means of the bearing device 40 provided therein.

We claim:

1. An apparatus for winding an advanced yarn onto a bobbin tube to form a yarn package, comprising a revolver mounted for rotation about a central axis and having a circular perimeter, a revolver drive for rotating said revolver about said central axis, at least one winding spindle adapted for coaxially mounting a bobbin tube thereon, carrier means mounting said at least one winding spindle to said revolver so as to be rotatable about an axis parallel to and laterally offset from said central axis and for movement in an essentially radial direction with respect to said central axis between a first radially outer position which is radially outside the perimeter of the revolver and a second radially inner position which is radially within the perimeter of the revolver, a spindle drive mounted to said carrier means for directly rotating the at least one winding spindle, a pressure roll mounted so as to engage with an abutment force the circumferential surface of the package being wound on the bobbin tube mounted on the at least one winding spindle, and control means for independently controlling the revolver drive and the movement of the carrier means, such that the direction of movement of the at least one winding spindle away from the pressure roll can be changed during the build of a package on a bobbin tube mounted on the at least one winding spindle, to thereby change the abutment force between the pressure roll and the package.

2. The apparatus as defined in claim 1 wherein the carrier means comprises a rocker arm which is mounted to the revolver for pivotal movement about a pivot axis, and wherein said control means includes an actuator for selectively pivoting the rocker arm about the pivot axis.

3. The apparatus as defined in claim 1 wherein the carrier means comprises a bearing block which is mounted in a guide channel on the revolver so as to permit linear movement of the bearing block along the essentially radial direction, and wherein said control means comprises an actuator for selectively moving the bearing block along the guide channel.

4. The apparatus as defined in claim 1 wherein the carrier means comprises a spindle turret which is mounted on the revolver for rotation about a turret axis which is parallel to and laterally offset from said central axis, and with the winding spindle being mounted to the spindle turret for rotation about an axis parallel to and laterally offset from the turret axis, and wherein the control means includes a turret drive for rotating the spindle turret about the turret axis.

5. The apparatus as defined in claim 1 wherein said control means is configured to control both the revolver drive and the movement of the carrier means so as to permit stepwise movement of the revolver and the carrier means.

6. The apparatus as defined in claim 1 wherein said control means is configured to control the revolver drive and the movement of the carrier means so as to permit continuous movement of the revolver and the carrier means.

7. A method of winding an advancing yarn onto a bobbin tube to form a yarn package, comprising the steps of winding the advancing yarn onto a rotating bobbin tube which is coaxially mounted on a winding spindle, and including directly rotating the winding spindle by means of a direct spindle drive, traversing the advancing yarn at a location upstream of the bobbin tube to form a cross-wound package on the tube, engaging the surface of the package being formed with a pressure roll so as to engage the package with an abutment force, and selectively moving the winding spindle and thus the package being formed away from the pressure roll in both of two separate directions, wherein the winding spindle is rotatable mounted to a revolver which is mounted for rotation about a central axis, and wherein the winding spindle is mounted to said revolver so as to be rotatable about an axis parallel to and laterally offset from said central axis and for movement in an essentially radial direction with respect to the central axis, and wherein the step of selectively moving the winding spindle includes a first stage wherein the revolver is rotated about the central axis and the winding spindle is fixed with respect to movement in the radial direction, and a second stage wherein the winding spindle is moved in the radial direction while the revolver is rotatably fixed.

* * * * *

UNITED STATES PATENT AND TRADEMARK OFFICE
CERTIFICATE OF CORRECTION

PATENT NO. : 6,027,061

DATED : February 22, 2000

INVENTOR(S) : Busch et al.

It is certified that error appears in the above-identified patent and that said Letters Patent is hereby corrected as shown below:

Title page, [56] References Cited, U.S. PATENT DOCUMENTS, insert the following:

| | | |
|---|---|---|
| --3,845,911 | 11/1974 | Wyatt |
| 3,856,222 | 12/1974 | Wust |
| 3,857,522 | 12/1974 | Fink |
| 4,552,313 | 11/1985 | Sasaki--. |

Column 10, line 10, "rotatable" should read --rotatably--.

Signed and Sealed this

Twenty-sixth Day of December, 2000

*Attest:*

Q. TODD DICKINSON

*Attesting Officer*

*Director of Patents and Trademarks*